US005129763A

United States Patent [19]

Deusenbery

[11] Patent Number: 5,129,763

[45] Date of Patent: Jul. 14, 1992

[54] TRENCH SAFETY DEVICE

[76] Inventor: Anthony R. Deusenbery, 8720 Eelpot Rd., Naples, N.Y. 14512

[21] Appl. No.: 753,711

[22] Filed: Sep. 3, 1991

[51] Int. Cl.[5] ..... E02D 17/00

[52] U.S. Cl. ..... 405/283; 405/272

[58] Field of Search ..... 405/272, 282, 283, DIG. 7, 405/302.3

[56] References Cited

U.S. PATENT DOCUMENTS 3,016,714 1/1962 Cote ..... 405/283
3,818,709 6/1974 Gibson ..... 405/283
3,922,866 12/1975 Benning ..... 405/283
4,319,791 3/1982 Gibson ..... 405/283 X

*Primary Examiner*—David H. Corbin
*Attorney, Agent, or Firm*—Howard J. Greenwald

[57] ABSTRACT

A rotatable cage for protecting a worker in a trench is disclosed. This cage is comprised of two walls which are substantially congruent with each other, at least three cross-members joining said walls, and a cover for the exterior surface of each of said walls. The cross-members and the walls define, in combination, at least three open spaces on the perimeter of the rotatable cage.

19 Claims, 4 Drawing Sheets

TRENCH SAFETY DEVICE

FIELD OF THE INVENTION

An apparatus for protecting a worker in a trench. The device may be moved along the trench by the worker.

BACKGROUND OF THE INVENTION

In most trenching operations in which the depth of the trench is at least five feet, safety measures must be taken to protect the worker within the trench. Section 29 of the Code of Federal Regulations (at Part 1926, Subpart P) specifies that, under certain conditions, protective structures, such as trench shields, may be used in such trenches.

The trench shields provided by the prior art, however, are relatively expensive and cumbersome and, thus, are especially unsuitable for applications in which one worker needs to work on a long trenched section.

By way of illustration, a self-propelled trench shield is disclosed in United States patent of Seyle. The device of this Seyle patent is suitable for a situation in which it is required to simultaneously dig a trench and move the device. However, in situations in which a trench already has been dug and it is desirable to perform some secondary operation (such as, for example, cleaning the trench or laying pipe), the Seyle device would not be suitable and could not be self-propelled along the already-dug trench.

By way of further illustration, a rather large trench box is disclosed in U.S. Pat. No. 4,850,747 of Morelli. Because of the size of the trench box of this patent, it must be moved down the trench by a machine and, thus, is not suitable for operation by only one worker.

By way of further illustration, a self-propelled trench shoring machine is disclosed in U.S. Pat. No. 4,874,271 of Arnold. The device of this patent is rather large, complicated, and thus expensive. It does not appear to be suitable for use in irregularly shaped trenches; and it probably would require either several workers and/or a machine to place it into a trench.

It is an object of this invention to provide a trench shield which is relatively inexpensive to manufacture and use.

It is another object of this invention to provide a trench shield which can readily be moved within a trench by only one worker.

It is another object of this invention to provide a trench shield which can readily be moved within irregularly shaped trenches.

It is yet another object of this invention to provide a trench shield which is comprised of means for fixedly setting the shield in a desired position within the trench.

It is another object of this invention to provide a trench shield which does not substantially impede the vision of a worker disposed within such shield.

It is yet another object of this invention to provide a trench shield which is relatively lightweight.

SUMMARY OF THE INVENTION

In accordance with this invention, there is provided an apparatus for protecting a worker within a trench. This apparatus contains two walls which are connected to each other by cross members. Each of these walls is substantially congruent with each other, contains at least about five sides, and has a covered outer surface.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

Figure 1:
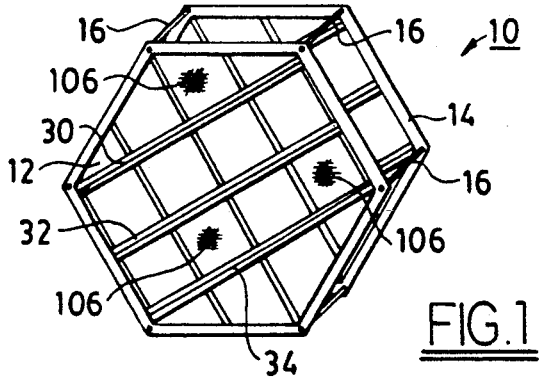
FIG. 1 is a perspective view of one preferred embodiment of applicant's claimed device.

FIG. 1 is a perspective view of one preferred embodiment of applicant's trench shield. Referring to FIG. 1, it will be seen that trench shield 10 is comprised of a first wall 12, a second wall 14, and means 16 for joining said first wall 12 and said second wall 14.

Referring again to FIG. 1, it will be seen that first wall 12 and second wall 14 are substantially congruent with each other, being substantially the same shape and size. It will also be seen that each of these walls 12 and 14 is comprised of at least about five sides. It is preferred that each of walls 12 and 14 be comprised of at least six sides. In one especially preferred embodiment, illustrated in the Figures, each of walls 12 and 14 is in the shape of a hexagon.

In one preferred embodiment, illustrated in the Figures, each of the sides of each of walls 12 and 14 will have a length which is substantially equal to the length of each of the other of said sides. In this embodiment, the angle defined by any two adjacent sides will be substantially equal to the angle defined by any two other adjacent sides. Thus, for example, referring to FIG. 3, each of angles 18, 20, 22, 24, 26, and 28 will be substantially equal.

Referring again to FIG. 1, it will be seen that each of walls 12 and 14 is comprised of a multiplicity of support struts 30, 32, and 34. These support struts are illustrated in more detail in FIG. 5 and will be described elsewhere in this specification.

Figure 2:
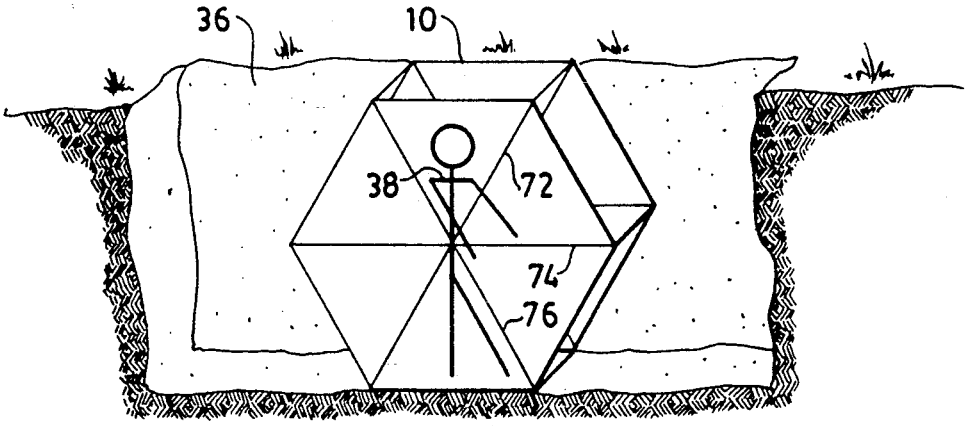
FIG. 2 is a "see-through" view of the device of FIG. 1 disposed within a trench, showing a worker disposed within said device.

FIG. 2 illustrates one embodiment of trench shield 10 disposed within a trench 36. When trench 36 is at least about 3.0 feet wide and at least about 5.0 feet deep, applicant's trench shield is especially suited for use therein. Referring to FIG. 2, it will be seen that worker 38 is disposed within trench shield 10.

The area between walls 12 and 14 is substantially open, being occupied only by cross-members 16; and, worker 38 has substantially unimpeded visibility both in front of and behind trench shield 10.

In one embodiment, at least 95 volume percent of the area between walls 12 and 14 is open, and does not contain any structural member.

Figure 3:
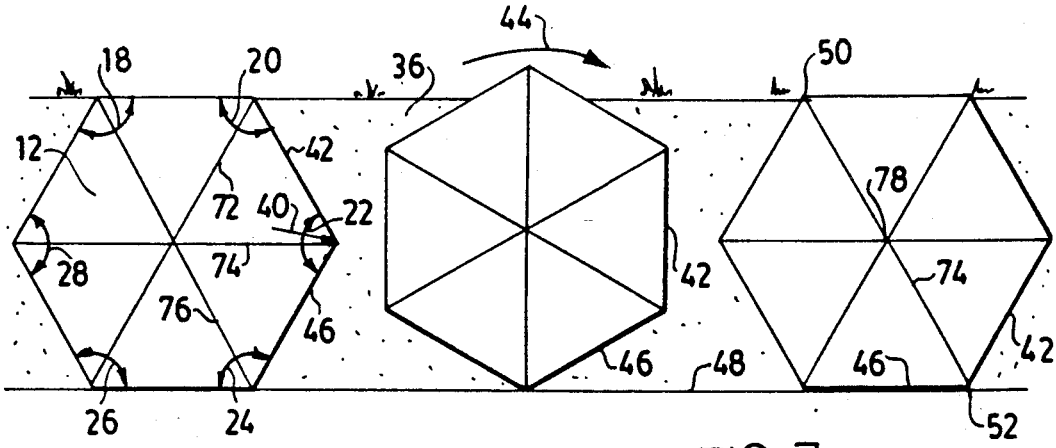
FIG. 3 is progressive view showing how applicant's device may be rotated within a trench.

FIG. 3 illustrates how the embodiment of trench shield 10 depicted in FIG. 2 may be rotated within trench 36. The worker 38 (not shown in FIG. 3) may stay inside trench shield 10 and initially apply force in the direction of arrow 40 on the cross member 16 (not shown in FIG. 3) located at one end of side 42 of wall 12. This force will cause trench shield 10 to rotate in the direction of arrow 44 and to finally settle in a position in which side 46 is eventually setting on the ground 48.

In general, applicant's trench shield 10 weighs from about 200 to about 500 pounds and, preferably, weighs from about 250 to about 450 pounds. In one preferred embodiment, trench shield 10 weighs from about 250 to about 350 pounds.

Referring again to FIG. 3, it is preferred that the maximum distance across the perimeter of walls 12 and/or 14 is less than 15.0 feet. Thus, for example, the distance between any two opposing corners of the sides of each of walls 12 and 14, such as, e.g., opposing corners 50 and 52 of wall 12, is at least about 6.5 feet and, preferably, is at least about 7.0 feet. In one especially preferred embodiment, the distance between any two opposing corners of the sides of each of walls 12 and 14 is at least about 8.0 feet. However, it is preferred that the distance between any two opposing corners of the sides of each of walls 12 and 14 not exceed about 12 feet and, more preferably, not exceed about 8.5 feet.

Figure 4:
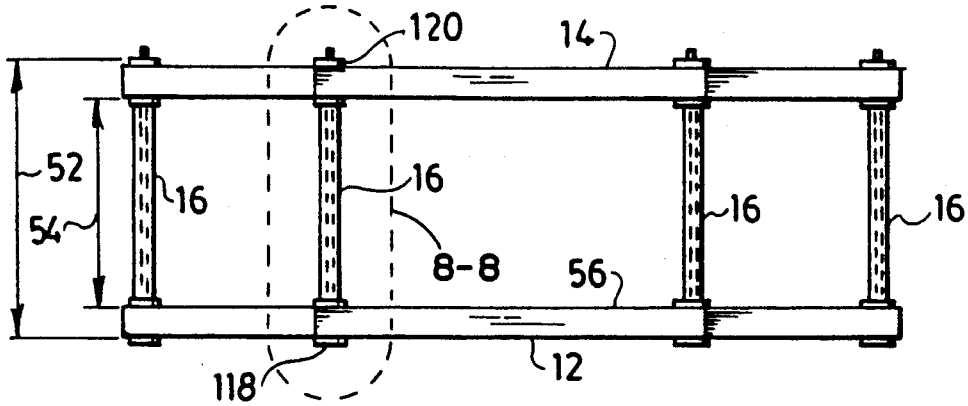
FIG. 4 is partial sectional view of the device of FIG. 1, showing one preferred cross-member used in said device.

FIG. 4 is a partial end view of the embodiment of FIG. 1, illustrating cross-members 16. It is preferred that each of cross members 16 have a length 52 which is substantially equal to the length of each of the other cross-members 16. In one embodiment, length 52 is from about 2.0 to about 8.0 feet and, more preferably, is from about 2.5 to about 3.5 feet. In one especially preferred embodiment, length 52 is about 3.0 feet.

Walls 12 and 14 are so connected by cross members 16 that the distance 54 between the interior surface 56 of wall 12 and the interior surface 58 of wall 14 is from about 24 to 66 inches and, more preferably, from about 30 to about 42 inches.

Any suitable structural member may be used as cross-member 16. Thus, by way of illustration, one may use aluminum tubing, reinforced aluminum tubing, steel tubing, and the like.

Cross-member 16 may be secured to walls 12 and 14 by any suitable fastening means. In the embodiment illustrated in FIGS. 4 and 5, cross-members 16 are secured to walls 12 and 14 by means of nuts 60, 62, 64, 66, 68, and 70.

Figure 5:
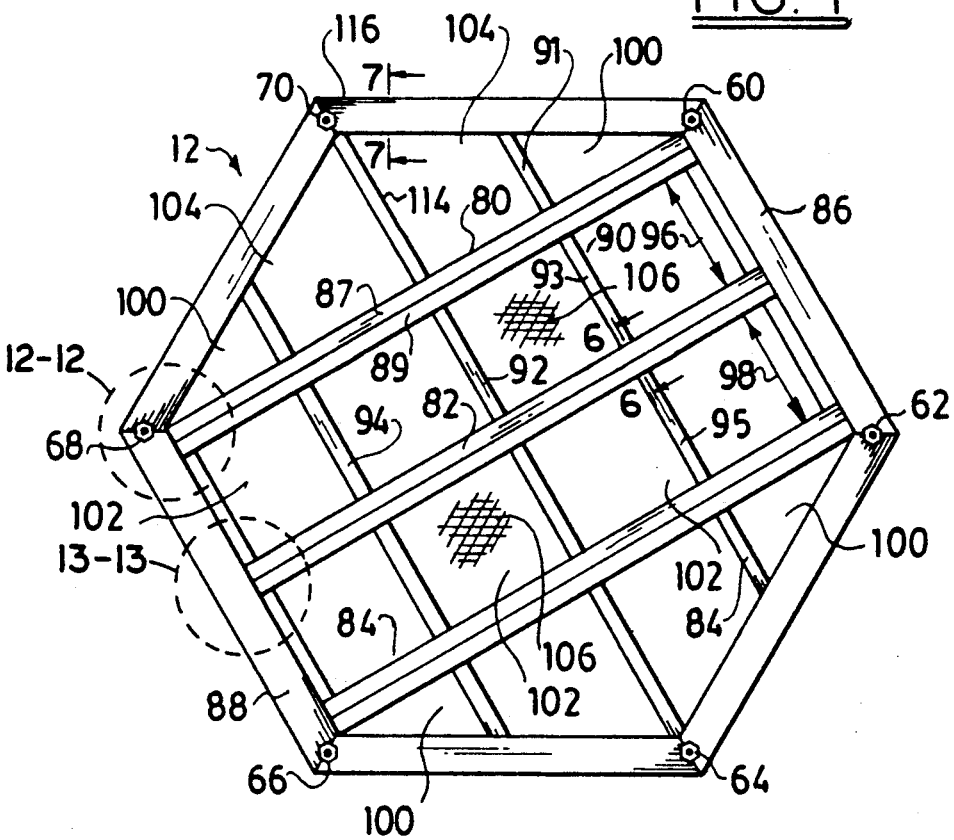
FIG. 5 is a side view of the device of FIG. 1.

In one embodiment, cross-member 16 is used to attach walls 12 and 14 at substantially the points where each side of each of walls 12 and 14 is contiguous with the adjacent side. These points of attachment and contiguity are illustrated in FIG. 5 by reference to the location of nuts 60, 62, 64, 66, 68, and 70.

It is preferred that at least three cross-members be used to attach wall 12 to wall 14 and, more preferably, to use at least four cross-members. In a more preferred embodiment, one uses at least five such cross members. However, it is essential to attach said cross-members at or near the perimeter of each of walls 12 and 14. The cross members may be secured to walls 12 and 14 substantially on said perimeters or, alternatively, within 9 inches of said perimeters. However, in applicant's device, it is preferred to have no cross members in the middle of said device.

Each of sides 12 and 14 is preferably reinforced by a multiplicity of struts. Thus, referring to the embodiment illustrated in FIGS. 2 and 3, one or more of struts 72, 74, and 76 may extend from one opposing corner of wall 12 (such as corner 50) to another opposing corner (such as corner 52). In this embodiment, the struts 72, 74, and 76 may be integral structures. Alternatively, or additionally, they may be two-piece structures which extend from one corner (such as corner 52) to a centerpoint (such as centerpoint 78).

In the embodiment illustrated in FIGS. 2 and 3, each of the struts 72, 74, and 76 forms an acute angle with each side of wall 12, and/or with each side of wall 14. Another embodiment is illustrated in FIGS. 1 and 5. Referring to FIG. 5, it will be seen that, in this embodiment three of the struts 80, 82, and 84 are substantially parallel to each other and form a substantially 90 degree angle with each of opposing sides 86 and 88 of wall 12; a similar arrangement is provided by struts (not shown) in wall 14 (not shown). Parallel struts 80, 82, and 84 are preferably composite structures formed by at least two integral structures, such as channel members 87 and 89 which are thereafter joined together to form an integral box beam strut.

In addition to parallel struts 80, 82, and 84, struts 90, 92, and 94 preferably intersect struts 80, 82, and 84 and form a substantially 90 degree angle at the point of such intersection. The struts 90, 92, and 94 are preferably multi-piece structures. Thus, referring to FIG. 5, strut 90 is comprised of section 91 (which abuts the top surface of integral strut 80), of section 93, which abuts the surfaces of integral struts 80 and 82), of section 95 (which abuts the surfaces of integral struts 82 and 84), and of section 97 (which abuts the surfaces of integral strut 84). Each section of struts 90, 92, and 94 is preferably an integral structural member such as, e.g., a channel or angle iron.

In the preferred embodiment illustrated in FIGS. 1 and 5, the sections of multi-piece struts 90, 92, and 94 are preferably welded to integral struts 80, 82, and 84 at the points at which the abut said struts. Other permanent means of attaching said sections to said struts will be apparent to those skilled in the art and also may be used.

Referring again to FIG. 5, it is preferred that the distance 96 between the interior surfaces of struts 80 and 82 be substantially equal to the distance 98 between the interior surfaces of struts 82 and 84. It is also preferred that the distances between the interior surfaces of struts 80, 92, and 94 be substantially equal.

In the preferred embodiments illustrated in FIGS. 1 and 5, the intersections of struts 80, 82, 84, 90, 92, and 94 with each other and with the sides of walls 12 and 14 creates a series of shapes defined by three, or four walls, such as triangular shapes 100, rectilinear shapes 102, and quadrangle shapes 104. In the preferred embodiment illustrated in FIGS. 1 and 5, the open areas of walls 12 and 14 enclosed within the walls defining said shapes are preferably covered with screening material, such as wire mesh, which will allow air and light to pass from the outside of each of walls 12 and 14 to the interior of shield 10 but, however, will prevent large clumps of dirt from passing through said walls.

Any suitable cover material, such as screening, may be used. In addition to wire mesh, one may use screening from other materials such as plastic, reinforced fiberglass, and the like In one preferred embodiment, the screen openings are about 0.125 inches, and 12 gauge wire mesh is used.

The screening material may be connected to walls 12 and 14 by any conventional means. Thus, one may connect such screening to one or more of the sides of walls 12 and/or 14. Alternatively, or additionally, one may connect the mesh to the struts which define the aforementioned triangular and/or rectilinear and/or quadrangle shapes.

Figure 6:
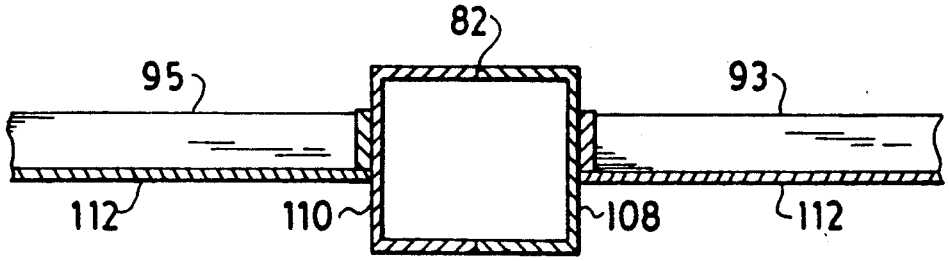
FIG. 6 is a partial sectional view of the device of FIG. 5, taken along lines 6—6.

FIG. 6 illustrates one means of connecting such screening. Sections 93 and 95 of strut 90 abut integral strut 82 at surfaces 108 and 110 and are attached thereto by suitable means such, e.g., welding. Referring to FIG. 6, it will be seen that wire mesh 112 may be attached to section 93 and/or section 95 and/or strut 82 (not shown). The wire mesh 112 may be connected by conventional attachment means such as welding, riveting, adhesive means, and the like.

Regardless of how the cover material, such as wire mesh 112, is connected to walls 12 and 14, it is preferred that at least about 90 volume percent of the exterior surface of said wall be covered by said mesh. It is more preferred that at least about 95 volume percent of the exterior surface of said wall be covered by said mesh.

Figure 7:
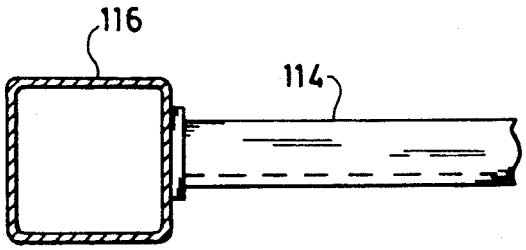
FIG. 7 is a partial sectional view of the device of FIG. 5, taken along lines 7—7.

FIG. 7 illustrates one means of connecting a strut, such as strut 92, to a side of wall 12. Referring to FIG. 5, it will be seen that strut 92 is comprised of section 114 which is attached to side 116 of wall 12. Referring again to FIG. 7, it will be seen that, in this embodiment, section 114 is joined to section 116 by conventional means such as, e.g., welding.

In the preferred embodiments illustrated in the Figures, walls 12 and 14 are defined by at least five perimeter members which, preferably, have equal lengths. In the preferred embodiment illustrated in FIG. 7, these perimeter members consist essentially of square tubing which, preferably, is aluminum square tubing. In this embodiment, it is preferred to use 4.0 inch × 4.0 inch square tubing which has a wall thickness of about 0.25 inches. In other embodiments, one may use circular aluminum tubing with a diameter of from about 2 to about 6 inches, rectangular structural tubing with a maximum dimension of from about 3 to about 6 inches and a minimum dimension of from about 1.5 to about 3.0 inches. One may use square tubing with sides ranging from about 1.5 to about 6.0 inches. One may use wall thicknesses ranging from about 0.125 to about 0.5 inches. Although aluminum is the preferred material, one may use tubing made out of steel, plastic, fiberglass, and the like.

It is preferred to use a square tubing structure to define each of the sides of walls 12 and 14 and to join each such side to another of the sides by conventional joining techniques, such as welding.

Figure 8:
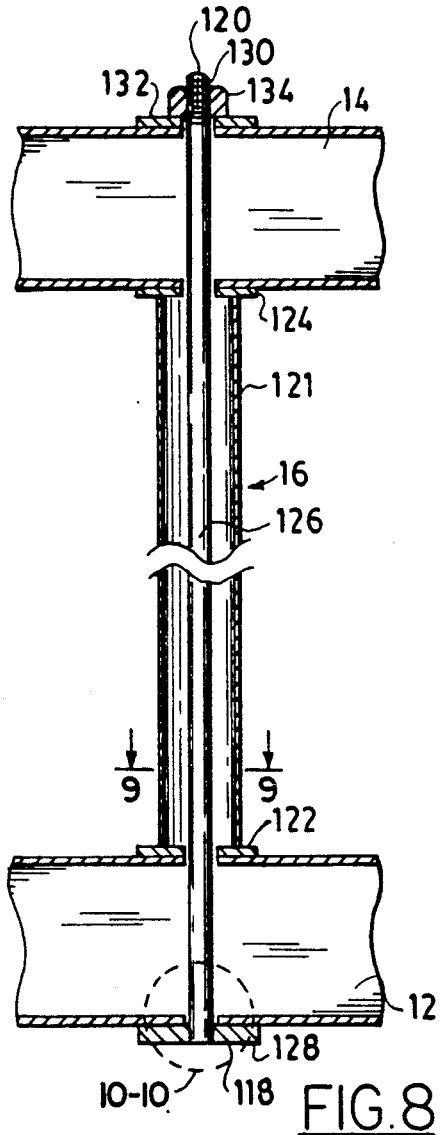
FIG. 8 is a sectional view of the cross-member depicted in FIG. 4.

FIG. 8 illustrates one preferred cross-member 16 which may be used in applicant's trench shield 10. Referring to FIG. 4, it will be seen that the particular cross-member 16 depicted in FIG. 8 extends from points 118 to 120 and connects walls 12 and 14. In the embodiment illustrated in FIG. 8, it will be seen that cross-member 16 is preferably comprised of tubular member 121 (which may, e.g., be aluminum tubing). Plates 122 and 124 are welded on the ends of tubular member 121 and haves orifices therethrough adapted to allow the passage of a rod 126 therethrough.

Tubular member 121 may be any structural tubular member which, preferably, is lightweight. Thus, for example, it may consist essentially of aluminum, steel, plastic, and the like. Thus, for example, it may be in the shape of a round tube, a square tube, a rectilinear tube, and the like.

The plates 122 and 124 attached to the tubular member 121 abut the interior surfaces of walls 12 and 14; and these plates are removably attached to these interior surfaces.

One means of removably attaching said plates 122 and 124 (and the tubular member 121 to which they are attached) to the walls 12 and 14 is illustrated in FIG. 8; other suitable means will be apparent to those skilled in the art. In the preferred embodiment illustrated in FIG. 8, steel rod 126 is comprised of a head 128, and a threaded end 130. A washer 132 is placed over said threaded end, and a nut 134 is used to tighten said threaded end and to thus compress tubular member 121 between walls 12 and 14.

Figure 9:
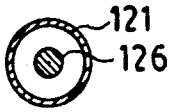
FIG. 9 is a sectional view of the cross-member of FIG. 8, taken along lines 8—8.
Figure 11:
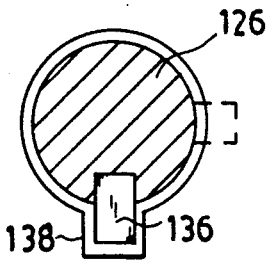
FIG. 11 is a sectional view of the device of FIG. 10, taken along lines 11—11.

FIG. 9 is a cross-sectional view of cross-member 16, illustrating rod 126 and tubular member 121.

Figure 10:
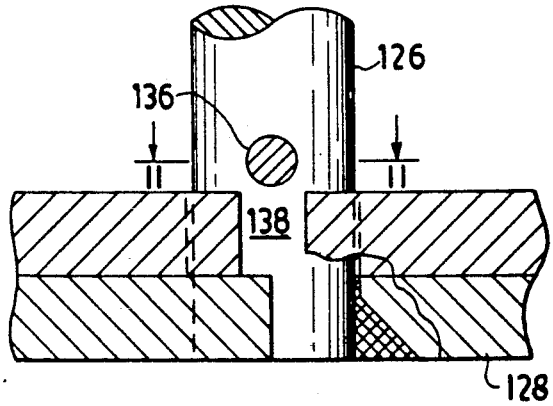
FIG. 10 is a sectional view of the cross-member of FIG. 8, taken along lines 10—10.

FIG. 10 illustrates one means of attaching rod 126 to wall 12. In this embodiment, rod 126 is comprised of a horizontally-extending steel dowel which is adapted to be captured by keyway 138 when rod 126 is suitably rotated. In this embodiment, keyway 138 is machined into wall 12.

Figure 12:
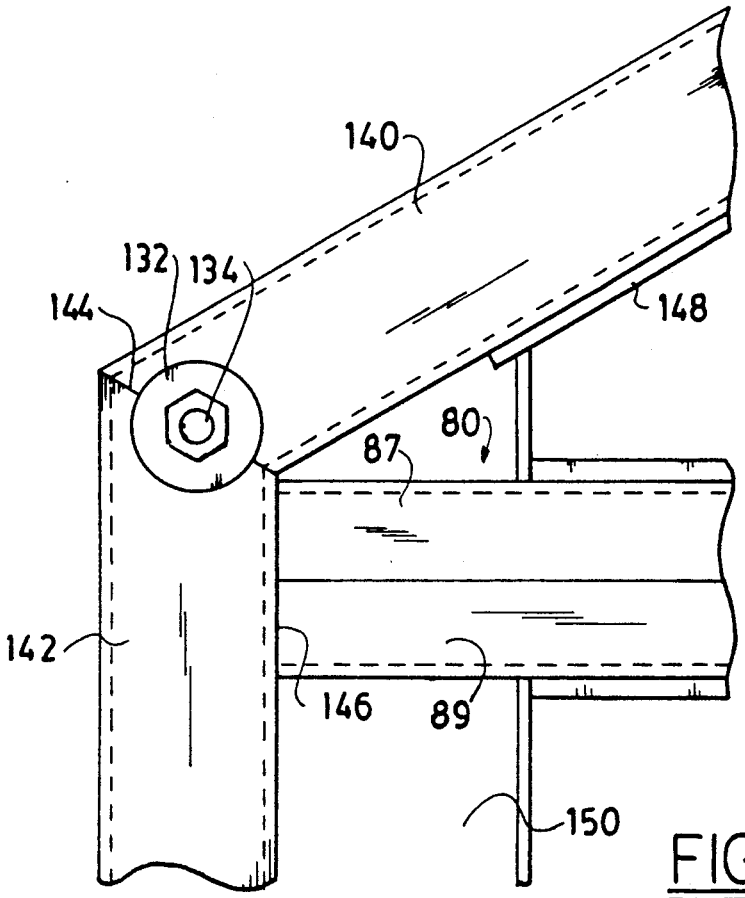
FIG. 12 is a partial side view of a corner of the apparatus depicted in FIG. 5.
Figure 13:
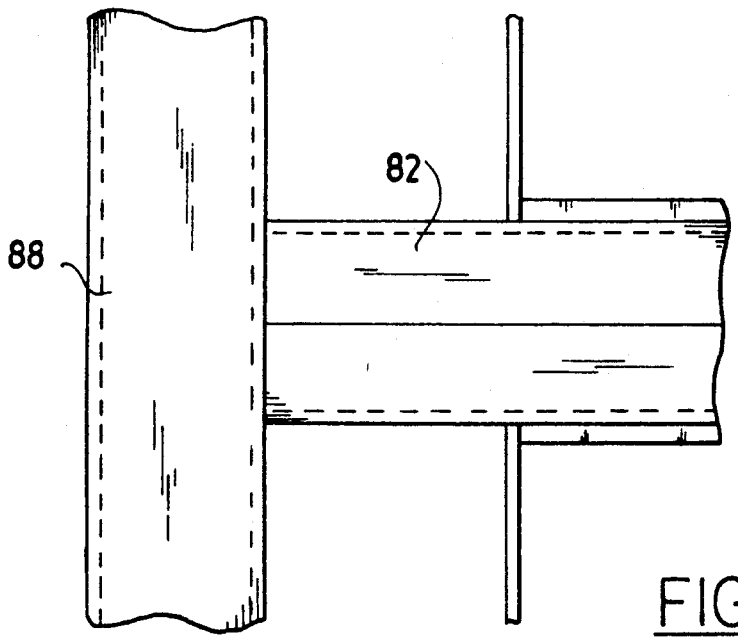
FIG. 13 is another partial side view of the apparatus depicted in FIG. 5.

FIG. 12 illustrates one preferred means for joining adjacent sides of wall 12 and/or wall 14 to each other. Referring to FIG. 12, it will be seen that, in this embodiment, side 140 is joined to side 142 at the juncture 144 where the ends of said sides abut by means of conventional fastening techniques such as, e.g., welding. The washer 132 and the nut 134 are utilized, as described above, to secure cross-member 16 (not shown) to wall 12.

Referring again to FIG. 12, integral strut 80 (which is comprised of sections 87 and 89 joined to each other) is joined to side 140 at juncture 146 by conventional joining means, such as welding.

Referring again to FIG. 12, it will be seen that a plate 148 is preferably welded to the interior surface of side 140. Wire mesh (not shown) may be attached to plate 148.

In the embodiment illustrated in FIG. 12, an aluminum angle 150 which is contiguous with side 142 is attached by conventional means (such as welding) to the interior surface of side 140.

In one embodiment, at least about 90 weight percent of the trench shield 10 is comprised of a metal or metal alloy. Thus, it is preferred that at least 90 weight percent of the trench shield 10 be comprised of a material selected from the group consisting of aluminum, aluminum alloys, columbium, magnesium alloys, mild steel, and the like.

The cross-members, together with the first wall 12 and the second wall 14, define a series a open spaces along the perimeter of the device 10. There is at least three such open spaces, each of which preferably has a rectangular cross-section. It is preferred that there be at least four such open spaces, and it is more preferred that there be at least five such open spaces.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A rotatable cage for protecting a worker in a trench within which said worker can stand while said cage is being rotated, wherein said cage is comprised of a first wall, a second wall, and means for joining said first wall and said second wall, and wherein:

(a) said rotatable cage weighs from about 200 to about 500 pounds;

(b) each of said first wall and said second wall is substantially congruent with each other;

(c) each of said first wall and said second wall is comprised of at least five sides, wherein:

1. said sides of said first wall and said second wall define the perimeters of said first wall and said second wall, and 2. the maximum distance across the perimeter of said first wall and said second wall is from about 6.5 to about 15.0 feet;

(d) each of said first wall and said second wall is comprised of means for covering said wall;

(e) said means for joining said first wall and said second wall is comprised of at least three cross members, wherein each of said cross-members is from about 2.0 to about 8.0 feet long and has a length which is substantially equal to the length of each of the other of said cross-members, wherein said cross-members are only joined to said first wall and said second wall within from about 0 to about 9.0 inches of the perimeter of said first wall and said second wall, wherein no structural members join said first wall and said second wall except for such cross-members, and wherein the space between said first wall, said second wall, and said cross-members is entirely open, whereby a man can stand in said rotatable cage; and (f) said first wall, said second wall, and said cross-members define at least three open spaces which are adapted to allow a worker standing within said rotatable cage access to and visibility of the area outside the perimeter of said cage.

2. The rotatable cage as recited in claim 1, wherein said cage is comprised of at least five cross members.

3. The rotatable cage as recited in claim 2, wherein said first wall, said second wall, and said cross-members define at least five open spaces.

4. The rotatable cage as recited in claim 3, wherein each of said first wall and said second wall is comprised of at least about six sides.

5. The rotatable cage as recited in claim 4, wherein each of said six sides has a length which is substantially equal to the length of each of the other of said six sides.

6. The rotatable cage as recited in claim 5, wherein said cage weighs from about 250 to about 450 pounds.

7. The rotatable cage as recited in claim 6, wherein the distance between the interior surfaces of said first wall and said second wall is from about 24 to about 66 inches.

8. The rotatable cage as recited in claim 7, wherein said first wall is comprised of at least a first strut, a second strut, and a third strut.

9. The rotatable cage as recited in claim 8, wherein each of said first strut, said second strut, and said third strut are substantially parallel to each other.

10. The rotatable cage as recited in claim 9, wherein said second wall is comprised of at least a fourth strut, a fifth strut, and a sixth strut.

11. The rotatable cage as recited in claim 10 wherein each of said fourth strut, said fifth strut, and said sixth strut are substantially parallel to each other.

12. The rotatable cage as recited in claim 11, wherein said means for covering said wall is comprised of mesh.

13. The rotatable cage as recited in claim 12, wherein said mesh is wire mesh.

14. The rotatable cage as recited in claim 13, wherein each of said sides is defined by a tubular structural member.

15. The rotatable cage as recited in claim 14, wherein said tubular structural member is square tubular structural member.

16. The rotatable cage as recited in claim 15, wherein said cross-member consists essentially of aluminum.

17. The rotatable cage as recited in claim 16, wherein said cross-member is comprised of a hollow tubular segment.

18. The rotatable cage as recited in claim 17, wherein said cross-member is comprised of a solid rod.

19. The rotatable cage as recited in claim 18, wherein each of said first wall and said second wall consists essentially of aluminum.

* * * * *